US007517837B2

(12) United States Patent
Kurosky et al.

(10) Patent No.: US 7,517,837 B2
(45) Date of Patent: Apr. 14, 2009

(54) BIODEGRADABLE LUBRICANTS

(75) Inventors: John M. Kurosky, Stony Creek (CA); Zulfiqar Ahmed Tahir, Randolph, NJ (US)

(73) Assignee: Anderol, Inc., East Hanover, NJ (US)

( * ) Notice: Subject to any disclaimer, the term of this patent is extended or adjusted under 35 U.S.C. 154(b) by 0 days.

(21) Appl. No.: 10/443,514

(22) Filed: May 22, 2003

(65) Prior Publication Data

US 2004/0235679 A1 Nov. 25, 2004

(51) Int. Cl.
*C10M 105/38* (2006.01)
*C10M 169/00* (2006.01)

(52) U.S. Cl. ..... 508/485; 508/174; 508/180; 508/391; 508/428; 508/519; 508/579

(58) Field of Classification Search ..... 508/579, 508/428, 174, 180
See application file for complete search history.

(56) References Cited

U.S. PATENT DOCUMENTS

| | | | | |
|---|---|---|---|---|
| 2,285,855 | A | 6/1942 | Downing et al. | |
| 3,871,837 | A * | 3/1975 | Bedague et al. | 44/389 |
| 4,155,770 | A * | 5/1979 | Doumani | 106/267 |
| 4,310,428 | A | 1/1982 | Ciuti | |
| 4,560,489 | A | 12/1985 | Muir et al. | |
| 4,597,880 | A | 7/1986 | Eliades | |
| 4,753,742 | A * | 6/1988 | Wilhelm, Jr. | 508/428 |
| 4,824,584 | A | 4/1989 | Muir et al. | |
| 4,826,945 | A | 5/1989 | Cohn et al. | |
| 5,126,062 | A | 6/1992 | Barnes | |
| 5,135,669 | A * | 8/1992 | Brois et al. | 508/428 |
| 5,143,640 | A * | 9/1992 | Moxey | 508/580 |
| 5,190,678 | A | 3/1993 | Swartz et al. | |
| 5,213,697 | A | 5/1993 | Vinci et al. | |
| 5,308,514 | A | 5/1994 | Olson et al. | |
| 5,338,467 | A | 8/1994 | Olson et al. | |
| 5,401,424 | A | 3/1995 | Vinci et al. | |
| 5,425,894 | A | 6/1995 | Welch et al. | |
| 5,451,332 | A * | 9/1995 | Lawate | 508/280 |
| 5,595,681 | A | 1/1997 | Panandiker et al. | |
| 5,681,800 | A | 10/1997 | Duncan et al. | |
| 5,858,933 | A * | 1/1999 | Nikoloff | 508/428 |
| 5,955,402 | A | 9/1999 | Hirata et al. | |
| 6,204,225 | B1 | 3/2001 | Lightcap, Jr. | |
| 6,436,883 | B1 * | 8/2002 | Nieh | 508/579 |
| 6,448,207 | B1 * | 9/2002 | Fukutani et al. | 508/175 |
| 6,656,888 | B1 * | 12/2003 | Zehler | 508/485 |
| 6,664,216 | B1 * | 12/2003 | Lakes et al. | 508/485 |
| 6,828,287 | B1 * | 12/2004 | Lakes et al. | 508/485 |

FOREIGN PATENT DOCUMENTS

GB 859 438 A 1/1961

OTHER PUBLICATIONS

Kasperen, Janice, "Going Green: Biodegradable Products For Your Hydraulic System" May 2000, XP002297600; Online.
Exxonmobil Lubricants & Specialties, "Mobil Glygoyle HE Series" 2001, XP002297657; Online.
Bitzer Kuhlmaschinenbau GMBH, Sindelfingern (DE). "Technical Information: Polyolester Oils BSE 32 and BSE 55 for Reciprocating Compressors" Apr. 1997, XP002297659; Online.

* cited by examiner

*Primary Examiner*—Ellen M. McAvoy
(74) *Attorney, Agent, or Firm*—Jaimes Sher

(57) ABSTRACT

Lubricant compositions based on a biodegradable base oil, such as a polyol ester or polyalkylene glycol, a calcium sulfonate based thickener and a naturally occurring phospholipid as an anti-wear additive, such as lecithin for environmentally sensitive applications and when having a specific gravity greater than 1.0 at 60° F. (15.6° C.) for marine applications are provided. The thickener may include a linear alkybenzene sulfonic acid, acetic acid and 12 hydroxystearic acid and a calcium carbonate solid film lubricant. The lubricant submerges when dispensed on water avoiding formations of a surface sheen and biodegrades when submerged resulting in a water ecology friendly lubricant.

13 Claims, No Drawings

BIODEGRADABLE LUBRICANTS

BACKGROUND OF THE INVENTION

This invention relates to biodegradable lubricants, and more particularly to semi-fluid grease compositions based on synthetic or natural base oils including esters and glycols and thickener systems including a naturally occurring phosphatide extended performance and anti-wear agent designed to be biodegradable for environmentally sensitive applications and such compositions having a specific gravity greater than or equal to 1.0 for maritime, inland, coastal waterways, water purification and waste water treatment applications.

There is a continuing need to provide lubricant compositions which are biodegradable. This is particularly true with respect to lubricants for bearings and other marine applications and 2-stroke engines. These engines are often small gasoline engines used in recreational vehicles, such as motorboats, mono-skis for water use, snowmobiles and in lawn equipment. Thus, all such uses are in sensitive environments subject to pollution. Absent an acceptable biodegradability level, exhaust and leakage of lubricants tend to pollute forests, rivers, lakes and other waterways.

A stem tube bearing is one of the most important bearing in a propeller driven ship and is often the subject of controversy. It is reported that failures of oil lubricated metal propeller shafts have a failure rate as high as 10% on ships having tailshafts equal to or greater than 600 mm diameter. The failures are associated with seal failure resulting in the spreading of oil onto the water. Stern tube lubricants have been designed to lubricate the load carrying bearings for marine vessel propeller shafts. These mineral oil formulations cause a "sheen" or iridescent appearance on the surface of water upon leakage from a stern tube seal. The mineral oil and additives that augment the performance of these types of lubricants are not readily biodegradable and usually environmentally harmful.

In water purification and wastewater treatment facilities, several pieces of machinery are lubricated with biodegradable lubricants. However these lubricants have a density lower than that of water, or a specific gravity less than 1.0 at 60° F. (15.6° C.). These lighter than water lubricants float on the surface and may cause a surface sheen. Removal of the lubricant requires expensive skimming equipment further downstream.

Biodegradability is measured pursuant to the OECD 301B test known as the Modified Sturm test and was adopted by the Organization for Economic Cooperation Development in 1979. The test has been adopted as a European Union standard for biodegradability as test standard EU C.4-C. The biodegradability test involves the measurement of the amount of $CO_2$ produced by the test compound, which is, in turn, expressed as a percent of the theoretical $CO_2$ the compound could produce calculated from the carbon content of the test compound. The test is performed to measure released $CO_2$ trapped as $BaCO_3$ and is well known to those in the art and will not be set forth herein in detail. Generally, lubricants having a biodegradability of over 60% pursuant to the OECD 301B test are considered to have acceptable biodegradability characteristics. By way of comparison, mineral oils in the same test show typically results of between 20 to 30 percent.

Present biodegradable basestocks based on branched chain synthetic esters and lubricants formed therefrom are disclosed in U.S. Pat. No. 5,681,800. Here, branched chain fatty acids provide the desired viscometrics, low temperature properties, lubricity, biodegradability and solubility of additives therein. A 2-stroke engine lubricant based on polyneopentyl polyol ester lubricants is described in U.S. Pat. No. 6,551,968. These oils and lubricants that float on the water's surface adhere to the skin, fur and feathers of marine life and birds, causing injury to animals and plants. This commonly recognized iridescent film also tends to reduce transmission of oxygen into the water, thereby endangering marine life.

Overbased calcium sulfonate based grease thickening systems are also well known in the art. These are disclosed in U.S. Pat. Nos. 4,560,489 and 5,308,514. These greases usually contain calcium borate, making these systems not desirable for environmentally sensitive uses.

Various known lubricants having biodegradable properties are available, leakage tends to cause the lubricants to collect on the surface of the water. Accordingly, it is desirable to provide a biodegradable lubricant suitable for environmentally sensitive applicants and that will not collect on the surface of water and is readily biodegradable by aquatic organisms and overcomes common environmental hazards associated with lubricants.

SUMMARY OF THE INVENTION

Generally speaking, in accordance with the invention, an improved biodegradable lubricant based on natural or synthetic base oils, including esters or glycols, an overbased calcium sulfonate thickener system and a naturally occurring phospholipid, such as α-lecithin, to impart extended performance and anti-wear properties is provided. The synthetic esters utilized are designed to be biodegradable and generally are characterized by a specific gravity greater than or equal to 1.0 at 60° F. (15.6° C.) making them well suited for marine applications. The lubricants may also include performance enhancing additives in the form of solid film lubricants.

Preferred compositions include polyol esters base oils formed from a neopentyl polyol having from 5 to 8 carbon atoms esterified with a linear monocarboxylic acid or acid mixture having from 5 to 18 carbon atoms and polyalkylene glycol base oils based on polyethylene glycol, polypropylene glycol and copolymers of ethylene glycol and propylene glycol. The base oils are thickened with an overbased calcium sulfonate, a linear alkybenzene sulfonic acid and a fatty acid of from 12 to 24 carbon atoms and the α-lecithin. The preferred lubricant composition and additives has a specific gravity greater than 1.0 causing it to sink when expelled on the water thereby avoiding a surface sheen on the water. The lubricant then biodegrades when submerged.

Accordingly, it is an object of the invention to provide a synthetic ester lubricant basestock having improved biodegradability.

Another object of the invention is provide an improved synthetic ester lubricant having improved biodegradability suitable for use in marine applications.

A further object of the invention is to provide a synthetic ester lubricant having an improved biodegradability that will not form a surface sheen when dispensed on water.

Yet another object of the invention is to provide an improved biodegradable lubricant having improved lubricating properties yet have a specific gravity greater than 1.0 at ambient temperatures.

Still other objects and advantages of the invention will in part be obvious and will in part be apparent from the specification.

The invention accordingly comprises a composition of matter possessing the characteristics, properties, and the relation of components which will be exemplified in the composition hereinafter described, and the scope of the invention will be indicated in the claims.

DESCRIPTION OF THE PREFERRED EMBODIMENTS

The biodegradable greases and lubricants prepared in accordance with the invention are semi-fluid grease compositions based on natural oils, synthetic esters or glycol thickened with a calcium sulfonate thickener system and a performance enhancing naturally occurring animal or vegetable fatty oils, or phosphatide compound, such as lecithin. The synthetic esters utilized are designed to be biodegradable. For maritime, inland, coastal waterways, water purification and waste water treatment applications, they are characterized by a specific gravity greater than or equal to 1.0 at 60° F. (15.6° C.). The grease compositions may be augmented with performance enhancing additives. These additives may take the form of solid film lubricants. Preferably, the additives that augment the grease compositions are biodegradable or environmentally innocuous and are characterized by specific gravities greater than or equal to 1.0 at 60° F. (15.6° C.).

The lecithin added as an anti-wear agent is naturally occurring phosphatide found in all living organisms, both plant and animal. It is a mixture of diglycerides of stearic, palmitic and oleic acids, linked to the choline ester of phosphoric acid. Lecithin obtained from soybeans and soybean lecithin contains palmitic acid, stearic acid, palmitoleic, oleic, linoleic, linolenic and $C_{20}$ to $C_{22}$ acids. α-Lecithin has the following structural formula:

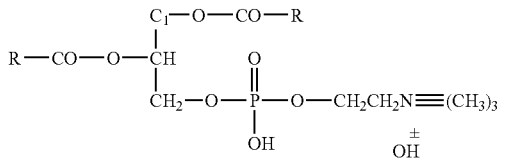

The synthetic ester base oil of the greases prepared in accordance with the invention is prepared by reacting at least one neopentyl polyol having from 5 to 8 carbon atoms and at least two hydroxyl groups, with a monocarboxylic acid mixture including at least one normal alkanoic acid having from 5 to 18 carbon atoms. The neopentyl polyol utilized to prepare the base oils used in compositions in accordance with the invention is at least one neopentyl polyol represented by the structural formula:

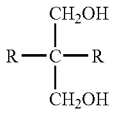

wherein each R is independently selected from the group consisting of $CH_3$, $C_2H_5$ and $CH_2OH$. Examples of such are neopentyl polyol, including pentaerythritol, trimethylolpropane, trimethylolethane, neopentyl glycol and the like. In some embodiments of this invention, the neopentyl polyol comprises only one such neopentyl polyol. In other embodiments it comprises two or more such neopentyl polyols.

The polyol may be a commercially available mono- or di-pentaerythritol, technical grade pentaerythritol, trimethylolpropane or neopentyl glycol. The monopentaerythritol, $C_5H_{12}O_4$ (MPE, CAS #=115-77-5) is a colorless solid with a melting point of 255°-259° C.; dipentaerythritol, $C_{10}H_{22}O_7$ (DPE, CAS #=126-58-9) is a colorless solid having a melting point of 215°-218° C.; and commercially available technical grade pentaerythritol includes monopentaerythritol and typically between about 6 to 15 weight percent dipentaerythritol.

The straight chain monocarboxylic acids used to prepare the esters include those having between 5 and 18 carbon atoms, and preferably 5 to 10 carbon atoms, such as valeric acid (pentanoic acid), caproic acid (hexanoic acid), oenanthic acid (heptanoic acid), caprylic acid (octanoic acid), pelargonic acid (nonanoic acid), capric acid (decanoic acid) and mixtures thereof. In the preferred embodiments of the invention, the polyol is a monopentaerythritol or technical grade pentaerythritol based polyol esterified with at least one linear monocarboxylic acid having from 5 to 10 carbon atoms. Preferably, the straight chain acid component is valeric ($C_5$) or is a mixture of heptanoic ($C_7$) and caprylic-capric ($C_8$-$C_{10}$). The caprylic-capric acid is identified as having between 8 and carbon atoms, but actually includes $C_6$ to $C_{12}$ acids and is substantially free of $C_{12}$ acid (less than 1%). The amount of the preferred heptanoic and caprylic-capric mixture straight chain acid component suitable for use in preparing esters utilized in the invention may vary widely. For example, the mixture may be from about 30 to 70 weight percent heptanoic acid and the balance the caprylic-capric mixture. In a preferred embodiment, the normal acid mixture is about 40-60 parts by weight of heptanoic acid and the balance caprylic-capric acids.

During preparation of the ester, the acid mixture is present in the reaction mixture to form the ester in an excess of about 5 to 10 weight percent for the amount of the polyol mixture used. The excess acid is used to force the reaction to completion. The excess acid is not critical to carrying out the reaction except that the smaller the excess, the longer the reaction time. After the reaction is complete, the excess acid is removed by stripping and refining. Generally, the esterification reaction is carried out in the presence of conventional catalysts. For example, a tin or titanium based catalyst of such a catalyst may be used. Tin oxalate is an example.

The overbased calcium sulfonate thickener system used includes:

| Ingredient | Amount Present (% by weight) |
|---|---|
| Overbased calcium sulfonate | 10-15 |
| Linear alkylbenzene sulfonic acid | 0.45-0.90 |
| Low molecular weight alcohol solvent | 0.5-0.60 |
| Low molecular weight acid | 0.10-0.30 |
| 12-hydroxystearic acid | 2.5-5.0 |

The overbased calcium sulfonate has a total base number (TBN) of 300 to 400 mgKOH/g in a mineral oil, white oil or a synthetic hydrocarbon diluent. The lower alcohol solvent may be a monoalcohol having from 2 to 5 carbon atom, preferably three; such as isopropyl alcohol. The lower acid is a monocarboxylic acid having from 1 to 5 carbon atoms, preferably acetic or valeric acids. The solid film lubricant is calcium carbonate.

The lubricants prepared in accordance with the invention may be characterized as including:

| Ingredient Range | Amount Present (% by weight) | Preferred (% by weight) |
|---|---|---|
| Biodegradable base oil | 55-90 | 65-85 |
| Overbased calcium sulfonate thickener system | 7.5-25 | 10-20 |
| Phosphatide anti-wear agent | 5-10 | 6-8 |
| Solid film lubricant | 1-4 | 2-3 |

The process to prepare the greases and lubricants in accordance with the invention is as follows and described in connection with the following examples.

The desired amount of overbased calcium sulfonate is charged into a kettle and heated with agitation to a temperature 160 to 185° F. (71.1 to 85° C.) and between 35 to 45 percent of the total amount of oil and water equivalent 4 to 6 percent of the total batch size is added and the temperature maintained while adding the linear alkylbenzene sulfonic acid solubilized in the alcohol. These three components are mixed while adding the acidic acid.

The mixture is slowly heated for between 30 to 60 minutes to about 212° F. (100° C.) with agitation before turning on full heat.

With the mixture temperature between 235 to 250° F. (112.8 to 121.1° C.) about 20 percent of the total amount of oil is added upon thickening. At this time all of the 12 hydroxystearic acid is added with the mixture heated to a temperature of 385 to 400° F. (196.1 to 204.4° C.).

The reaction mixture is then cooled and when at a temperature of between 350 to 365° F. (196.1 to 185° C.) 20 to 40 percent of the oil is added with the calcium carbonate.

When the mixture reaches a temperature less than 250° F. (121.1° C.) the grease is milled and an additional oil is added to obtain the desired viscosity. When the mixture is below 180° F. (82.3° C.) and the milling complete the α-lecithin is added.

The invention will be better understood with reference to the following examples. All percentages are set forth in percentages by weight, except when molar quantities are indicated. These examples are presented for purposes of illustration only, and are not intended to be construed in a limiting sense.

EXAMPLE 1

A biodegradable grease in accordance with the invention based on the following starting materials was prepared.

| Component | Function of Component | Weight % |
|---|---|---|
| Overbased Calcium Sulfonate (mineral oil diluent, TBN 400 mg KOH/g) | Thickening component | 11.15 |
| Linear Alkybenzene Sulfonic Acid | Thickening component | 0.60 |
| Isopropyl Alcohol | Solvent | 0.55 |
| Acetic Acid | Thickening component | 0.20 |
| Tech - PE-$C_{5-10}$ Ester | Biodegradable base oil | 74.40 |
| 12-hydroxystearic acid | Thickening component | 3.70 |
| Calcium Carbonate | Solid film lubricant | 2.40 |
| Lecithin (TAN <30 mg KOH/g) | Anti-wear additive | 7.00 |

The manufacturing process included the following steps.

1) Charge kettle with all the overbased calcium sulfonate and heat with agitation to a mixture temperature of 160-185° F. (71.1 to 85.0° C.)
2) Add 35-45% of the total amount of PE-$C_{5-10}$ ester to kettle and water to a quantity equivalent to 3-5% of the total batch size. Agitate and let mixture temperature rise to 160-185° F. (71.1 to 85.0° C.).
3) Add all of the linear alkylbenzene sulfonic acid solubilized in all of the isopropyl alcohol.
4) After step three components have mixed into the kettle mass for 10-15 minutes add all of the acetic acid.
5) Continue slowly heating (allow 30-60 minutes at bulk mixture temperature of 210-215° F. (98.9 to 101.7° C.)) with agitation before turning on full heat.
6) At mixture temperature 235-250° F. (112.8 to 121.1° C.) begin adding the Tech—PE-$C_{5-10}$ ester (approximately 20% of total amount) if mixture has become thick.
7) At mixture temperature 235-250° F. (112.8 to 121.1° C.) all of the 12-hydroxystearic acid may be added to the kettle.
8) Begin heating mixture to a temperature of 385-400° F. (196.1 to 204.4° C.).
9) After top temperature has been reached, begin cooling the batch.
10) At mixture temperature 350-365° F. (176.6 to 185.0° C.), begin adding PE-$C_{5-10}$ ester (approximately 20-40% of the total amount) and all of the calcium carbonate.
11) At mixture temperature less than 250° F. (121.1° C.), begin milling the grease.
12) Check penetration of mixture during the milling process and add PE-$C_{5-10}$ ester as required for obtaining desired penetration range.
13) At mixture temperature less than 180° F. (82.3° C.) and milling complete, add all of the Lecithin.

EXAMPLE 2

The physical and performance attributes of the grease prepared in Example 1 yield the following results.

| TEST DESCRIPTION | ASTM METHOD | Manufacturing Specification | Typical Result |
|---|---|---|---|
| Thickener Type | | Calcium Sulfonate | Calcium Sulfonate |
| Color | | Amber | Amber |
| NLGI Grade | D 217 | 00 | 00 |
| Base Oil Type | | Synthetic ester | Synthetic ester |
| Cone penetration @ 25° C. Worked 60 strokes | D217 | 400-430 | 425 |
| Base Oil Viscosity, cSt | D 445 | | |
| @ 40° C. | | 23-27.5 | 24.7 |
| @ 100° C. | | 4.8-5.5 | 5.1 |
| Base Oil Viscosity Index | D 2270 | 120 minimum | 139 |
| Base Oil Flash Point, ° C. | D 92 | 245 minimum | 257 |
| Base Oil Pour Point, ° C. | D 97 | −90 maximum | −100 |
| 4 Ball Wear, wear scar diameter mm | D 2266 | 0.6 maximum | 0.53 |
| 4 Ball Extreme Pressure | D 2596 | | |
| load wear index, kgf | | 40 minimum | 41.3 |
| weld load, kgf | | 400 minimum | 400 |

Biodegradability for the grease according to OECD 301B was 69.2%.

EXAMPLE 3

A biodegradable grease composition in accordance with the invention based on the following starting materials was prepared.

| Component | Function of Component | Weight % |
|---|---|---|
| Overbased Calcium Sulfonate (synthetic hydrocarbon diluent, TBN 400 mg KOH/g) | Thickening component | 12.30 |
| Linear Alkybenzene Sulfonic Acid | Thickening component | 0.60 |
| Isopropyl Alcohol | Solvent | 0.55 |
| Acetic Acid | Thickening component | 0.20 |
| DiPE - $C_5$ $C_{8/10}$ Ester | Biodegradable base oil | 73.10 |
| 12-hydroxystearic acid | Thickening component | 4.10 |
| Calcium Carbonate | Solid film lubricant | 2.15 |
| Lecithin (TAN <30 mg KOH/g) | Anti-wear additive | 7.00 |

Manufacturing Process

1) Charge kettle with all the overbased calcium sulfonate and heat with agitation to a mixture temperature of 160-185° F. (71.1 to 85.0° C.).
2) Add 35-45% of the total amount of the DiPE-$C_5$ $C_{8/10}$ ester to kettle and water to a quantity equivalent to 3-5% of the total batch size. Agitate and let mixture temperature rise to 160-185° F. (71.1 to 85.0° C.) again.
3) Add all of the linear alkylbenzene sulfonic acid solubilized in all of the isopropyl alcohol.
4) After step three components have mixed into the kettle mass for 10-15 minutes add all of the acetic acid.
5) Continue slowly heating (allow 30-60 minutes at bulk mixture temperature of 210-215° F. (98.9 to 101.7° C.)) with agitation before turning on full heat.
6) At mixture temperature 235-250° F. (112.8 to 121.1° C.) begin adding the DiPE-$C_5$ $C_{8/10}$ ester (approximately 20% of total amount) if mixture has become thick.
7) At mixture temperature 235-250° F. (112.8 to 121.1° C.) all of the 12-hydroxystearic acid may be added to the kettle.
8) Begin heating mixture to a temperature of 385-400° F. (196.1 to 204.4° C.).
9) After top temperature has been reached, begin cooling the batch.
10) At mixture temperature 350-365° F. (176.6 to 185.0° C.), begin adding the DiPE-$C_5$ $C_{8/10}$ Ester (approximately 20-40% of the total amount) and all of the calcium carbonate.
11) At mixture temperature less than 250° F. (121.1° C.), begin milling the grease.
12) Check penetration of mixture during the milling process and add the DiPE-$C_5$ $C_{8/10}$ ester as required for obtaining desired penetration range.
13) At mixture temperature less than 180° F. (82.3° C.) and milling complete, add all of the Lecithin.

EXAMPLE 4

The physical and performance attributes for the grease of Example 3 were as follows.

| TEST DESCRIPTION | ASTM METHOD | Manufacturing Specification | Typical Result |
|---|---|---|---|
| Thickener Type | | Calcium Sulfonate | Calcium Sulfonate |
| Color | | Amber | Amber |
| NLGI Grade | D 217 | 00 | 00 |
| Base Oil Type | | Synthetic ester | Synthetic ester |
| Cone penetration @ 25° C. | D217 | 400-430 | 412 |
| Worked 60 strokes | | | |
| Base Oil Viscosity, cSt | D 445 | | |
| @ 40° C. | | 50-56.5 | 55.2 |
| @ 100° C. | | 8.2-9.5 | 8.8 |
| Base Oil Viscosity Index | D 2270 | 120 minimum | 136 |
| Base Oil Flash Point, ° C. | D 92 | 274 minimum | 280 |
| Base Oil Pour Point, ° C. | D 97 | −43 maximum | −45 |
| 4 Ball Wear, wear scar diameter mm | D 2266 | 0.6 maximum | 0.48 |
| 4 Ball Extreme Pressure | D 2596 | | |
| load wear index, kgf | | 40 minimum | 40.5 |
| weld load, kgf | | 400 minimum | 400 |

Biodegradability for the grease according to OECD 301B was 46.0%.

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A lubricant composition, comprising:

(a) at least about 55 weight percent biodegradable base oil selected from the group consisting of:

i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 7.5 to 20 weight percent of an overbased calcium sulfonate thickener system; and (c) between about 5 to 10 weight percent of a phospholipid anti-wear agent;

wherein the lubricant composition has a specific gravity of at least 1.0 at 60° F. (15.6° C.).

2. The lubricant composition of claim 1, wherein the phospholipid is α-lecithin.

3. The lubricant composition of claim 1, wherein the biodegradable base oil further comprises a polyalkylene glycol.

4. The lubricant composition of claim 1, further including from about 1 to 4 percent by weight of a solid film lubricant.

5. The lubricant composition of claim 4, wherein the solid film lubricant is calcium carbonate.

6. The lubricant composition of claim 1, wherein the overbased calcium sulfonate thickener system comprises an overbased calcium sulfonate, a linear alkylbenzene sulfuric acid, a lower molecular weight alcohol solvent and a low molecular weight monocarboxylic acid.

7. The lubricant composition of claim 1, comprising:

| Ingredient | Amount Present (% by weight of the total composition) |
|---|---|
| Overbased calcium sulfonate | 10-15 |
| Linear alkylbenzene sulfonic acid | 0.45-0.90 |
| Low molecular weight alcohol solvent | 0.5-0.60 |
| Low molecular weight acid | 0.10-0.30 |
| 12-hydroxystearic acid | 2.5-5.0 |
| and the balance a biodegradable base oil. | |

8. A lubricant composition, comprising:

(a) at least about 55 weight percent biodegradable base oil that selected from the group consisting of, and i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 10 to 35 weight percent overbased calcium sulfonate thickener;

(c) between about 3 to 5 weight percent 12 hydroxystearic acid;

(d) between about 1.5 to 3.0 weight percent calcium carbonate; and (e) between about 5 to 10 weight percent of a phospholipid anti-wear agent;

wherein the lubricant composition has a specific gravity at least above 1.0 at 60° F. (15.6° C.).

9. The lubricant composition of claim 8, wherein the biodegradable base oil further comprises a polyalkylene glycol.

10. A method of lubricating in a marine application comprising using a lubricant composition having a specific gravity at least above 1.0 at 60° F. (15.6° C.), wherein the lubricant composition includes:

(a) at least about 55 weight percent biodegradable base oil selected from the group consisting of i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 10 to 35 weight percent of an overbased calcium sulfonate thickener; and (c) between about 2.5 to 5 weight percent 12 hydroxystearic acid;

(d) between about 1.5 to 3.0 weight percent calcium carbonate; and (e) between about 5 to 10 weight percent of a phospholipid anti-wear agent.

11. A method of lubricating in a marine application, comprising using a lubricant composition including the following:

(a) at least about 65 weight percent biodegradable base oil selected from the group consisting of and and at least one of i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 10 to 20 weight percent of an overbased calcium sulfonate thickener; and (c) between about 3 to 5 weight percent 12 hydroxystearic acid;

(d) between about 1.5 to 3.0 weight percent calcium carbonate; and (e) between about 6 to 8 weight percent of a phospholipid anti-wear agent;

wherein the lubricant composition has a specific graviy of at least 1.0 at 60° F. (15.6° C.).

12. A lubricant composition, comprising:

(a) at least about 45 weight percent biodegradable base oil selected from the group consisting of i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 10 to 35 weight percent overbased calcium sulfonate thickener;

(c) between about 2.5 to 5 weight percent 12 hydroxystearic acid;

(d) between about 3 to 5 weight percent calcium carbonate; and (e) between about 5 to 10 weight percent of a phospholipid anti-wear agent;

wherein the lubricant composition has a specific gravity at least above 1.0 at 60° F. (15.60° C.).

13. A lubricant composition, comprising:

(a) at least 55 weight percent biodegradable base oil selected from the group consisting of i) the reaction product of at least one neopentyl polyol and valeric acid ii) the reaction product of at least one neopentyl polyol and a mixture of heptanoic acid and caprylic-capric acid; and iii) the reaction product of at least one neopentyl polyol, valeric acid and a mixture of heptanoic acid and caprylic-capric acid;

(b) between about 7.5 to 20 weight percent of an overbased calcium sulfonate thickener system; and (c) between about 5 to 10 weight percent of a phospholipid anti-wear agent;

wherein the lubricant composition has a specific gravity of at least 1.0 at 60° F. (15.60° C.); and wherein the lubricant composition has a cone penetration measured at 25° C. in the range of 400-430.

* * * * *